United States Patent [19]

Popplewell

[11] 4,305,589

[45] Dec. 15, 1981

[54] SHUTTLECOCKS

[75] Inventor: Frank W. Popplewell, Saffron Walden, England

[73] Assignee: Dunlop Limited, London, England

[21] Appl. No.: 145,714

[22] Filed: May 1, 1980

[30] Foreign Application Priority Data

May 10, 1979 [GB] United Kingdom ..... 16289/79

[51] Int. Cl.[3] ..... A63B 67/18

[52] U.S. Cl. ..... 273/417

[58] Field of Search ..... 273/417

[56] References Cited

U.S. PATENT DOCUMENTS

D. 171,012 12/1953 Sametz ..... D21/207
2,556,029 6/1951 Cohan ..... 273/417
2,734,746 2/1956 Sametz et al. ..... 273/417

FOREIGN PATENT DOCUMENTS 602791 6/1948 United Kingdom ..... 273/417
1103364 12/1968 United Kingdom ..... 273/417
1386697 3/1975 United Kingdom ..... 273/417

*Primary Examiner*—Paul E. Shapiro
*Attorney, Agent, or Firm*—Stevens, Davis, Miller & Mosher

[57] ABSTRACT

The invention relates to moulded plastics shuttlecocks and aims to provide a moulded shuttlecock that resembles a Feather shuttlecock in appearance and simulates feather shuttlecock flight properties more closely than conventional moulded shuttlecocks. The visible effect is achieved by moulding a skirt structure having a diverging array of stems (5) and a vane area (4) at the outer part of the skirt, the vane area being a series of half leaves (7) and part half leaves (8), one attached on either side of each stem, the leaves being shaped to appear as overlapping feathers but without any actual overlap occurring. The desired flight properties are achieved by separating each half leaf and its associates part half leaf along part of the boundary line (10) where they would otherwise appear to overlap and forming these separated portions in different planes.

17 Claims, 3 Drawing Figures

SHUTTLECOCKS

This invention relates to shuttlecocks and particularly to the skirt structure thereof.

Over many years shuttlecocks and in particular Badminton shuttlecocks developed into a conventional structure composed mainly of feathers set into a substantially hemispherical member of cork or similar material called the "Striking Cap". Such shuttlecocks, herein called "Feather Shuttlecocks", are relatively fragile and expensive and efforts have been made for many years to utilise substitute materials in place of natural feathers.

In about 1950 moulded plastics shuttlecocks were developed successfully, such for example as are described in United Kingdom Patent Specification Nos. 670 147 and 686 403.

Where in this Specification it is required to draw a distinction between a feather shuttlecock and one made by moulding the skirt of artificial material, the latter will be referred to as a "Moulded Shuttlecock", or by reference to the material of which it is principally composed, e.g., a "Plastic Shuttlecock".

The conventional feather shuttlecock comprises an assembly of suitably trimmed feathers arranged in the form of a flared cone, at the narrow end of which the quills of the feathers are inset into a striking cap of substantially hemispherical shape usually made of cork. The quills of the feathers are shaven clean from the stem for some distance away from the striking cap. At the outer wide end of the cone, the flight portion of each feather is trimmed into a substantially oval shape and the feathers are mounted with flight portions in overlapping relationship. This portion of the feathered shuttlecock is herein termed the "Vane Area". One or two circumferential rows of binding such as thread are usually employed between the cap and the vane area. The overlapping of the flight portions of the feathers is usually obtained by angling the vexillum so that it intersects the surface of the cone of the shuttlecock and this angling can produce a spinning effect about the main axis of the shuttlecock. In some cases, curved shafted feathers giving a spiral effect have also been used, particularly in the cheaper types of feather shuttlecock.

The present invention is directed particularly to shuttlecocks in which the cone-shaped structure, corresponding to the assembly of feathers in a feather shuttlecock and herein termed the "Skirt", is produced by a moulding operation of a suitable substance, i.e., the invention is directed to moulded shuttlecocks.

To support and retain the shape of the skirt of a moulded shuttlecock, it is desirable to provide stiffening members similar in function and general location to the quill portions of a feather shuttlecock. These members are herein called "Stems". In the case of a plastics skirt moulded in the piece, the parts of these stems which converge at the narrow end of the cone, called the "Root Ends", finally merge together to form a continuous ring herein called the "End Ring".

The present invention is concerned with improvements in shuttlecocks of the type comprising a moulded skirt divisible into two zones, namely an outer zone, which is herein called the "lower Skirt", located remote from the cap and constituting the vane area, and an inner zone which is herein called the "Upper Skirt" located between the lower skirt and the cap. The lower skirt normally occupies not less than 30% and not more than 70% of the total length of the skirt, and the upper skirt is constituted by stems having large air spaces between them, not less than seven and not more than twenty five stems normally being provided. By "large air spaces" is meant air spaces which permit a sufficiently free passage of air from the outside to the inside of the shuttlecock, past the stems, to enable air flow to act on the surfaces of the stems in the upper skirt, for the purpose of controlling the motion of the shuttlecock.

The basic problem in designing shuttlecocks having skirts of moulded plastics material is to obtain the best possible flight characteristics, i.e., those most closely approaching the flight characteristics of a Feather Shuttlecock. One particularly desirable flight characteristic is that the shuttlecock should spin in flight at a suitable speed and will attain that speed even if the initial impact of racquet on shuttlecock imparts, for example, a higher than desired rate of spin.

In our co-pending British Patent Application Ser. No. 2016937A is described a shuttlecock which was designed to give desirable spin characteristics and also to have the added advantage of having a general outline similar to that of a Feather shuttlecock. Thus our co-pending application provides an integrally-moulded shuttlecock skirt having an end ring from which an array of diverging stems extends to form a generally conical skirt structure, the skirt being composed of an upper skirt and a lower skirt, the lower skirt being furthermost from the end ring and constituting the vane area of the skirt and the surface of the lower skirt being formed of a series of connected half leaves and complementary-shaped part half leaves, each stem in the vane area supporting one of the half leaves, the half leaves all lying to the same side of their respective stems and being joined to the adjacent stem on that side by one of the complementary-shaped part half leaves, whereby a visual effect of overlapping leaves is achieved, the trailing edges, as hereinafter defined, of the half leaves or of the part half leaves, being raised to form aerofoil projections, the projections having substantially continuous curvature along their length. Thus the projections are not partsevered from their respective leaves. Each stem therefore has a blade-like portion in the lower skirt or vane area, each blade comprising a half leaf and a part half leaf. (The word leaf is used herein merely to distinguish from the real feathers used in feather shuttlecocks. It will be appreciated that the expressions "half feather" and "part half feather" could equally well be used to describe the construction).

By "trailing edge" of the half leaf or part half leaf is meant in that application that free edge extending between the point of junction of each half leaf and its adjacent part half leaf and the point where the edge of the half leaf or part half leaf joins its stem, i.e., at the narrower end of the vane area. It is not essential to raise the whole length of the trailing edge and, for example, a minor proportion of its length at each end may be left unraised.

The shuttlecocks described in the two preceding paragraphs above will for convenience be called "Plastics Feather" shuttlecocks. These "Plastics Feather" shuttlecocks have been found to be satisfactory in performance and to have better flight characteristics than many previously proposed moulded shuttlecocks. However, it was still felt that there was room for further improvement whereby the flight characteristics of a Feather shuttlecock could be even more closely emulated. A consideration of the construction of a Feather shuttlecock and of a Plastics Feather shuttlecock suggested that the former could better be emulated by reconstruction of the latter to give a construction that would allow a more similar air flow through the shuttlecock skirt to that achieved in the Feather shuttlecock. This modified Plastics Feather shuttlecock has in fact been found to give a surprisingly accurate reproduction of the flight characteristics of a Feather shuttlecock and is believed to be a significant advance in the field of moulded shuttlecocks.

Accordingly the present invention provides an integrally-moulded shuttlecock skirt having an end ring from which an array of diverging stems extends to form a generally concial skirt structure, the skirt being composed of an upper skirt and a lower skirt, the lower skirt being furthermost from the end ring and constituting the vane area of the skirt and the surface of the lower skirt being formed of a series of connected half leaves and complementary-shaped part half leaves, each stem in the vane area supporting a half leaf to one side and a part half leaf to the other side, whereby a visual effect of overlapping leaves is achieved, each half leaf and its associated part half leaf being separated along part of the boundary line where they would otherwise appear to overlap, the separated portion of each half leaf being formed in a different plane to its corresponding separated portion of part half leaf.

The forming into different planes is preferably achieved by forming the separated portions of part half leaves so that they are moved inwardly with respect to the vane surface generally, i e so that the separated portions of the half leaves remain in the plane of the vane surface. Alternatively the separated portions of the half leaves could be moved outwardly, for example. In another alternative the two embodiments just described are combined so that the part half leaves are pressed inwardly and the half leaves pressed outwardly.

The portion of the boundary line along which separation occurs may in principle be towards the wider end of the skirt, towards the narrower end of the skirt or partway along the boundary line at both ends. The separation at both ends would appear to give a construction approaching more nearly to the Feather Shuttlecock but we have found in practice that separation at the wider end is both unnecessary and may be disadvantageous. It is unnecessary because the desired flight characteristics can be achieved with the separation effect at the narrower end only. It is disadvantageous because separation between half leaves and part half leaves at the wider end of the skirt gives a construction that is more susceptible to damage by impact of racket or floor.

In the preferred embodiment, where the separated part half leaf portions are formed inwardly, i.e., they appear as projections on the inside of the shuttlecock skirt, it will of course be necessary that the free edges, that in the absence of separation would have been defined as the trailing edge in our co-pending application, also be pressed in, since the free edge and the separated edge are integral. Thus in the preferred embodiment the inward projection is a substantially triangular flap or aerofoil whose sides are defined by a portion of the stem, the separated edge of the part half leaf and the free edge (or erstwhile trailing edge) of the part half leaf.

The separation of the portions of half leaf and part half leaf may be achieved during the moulding of the skirt or they may be moulded integrally and afterwards slit to separate them. The inwardly or outwardly formed projections or aerofoils are conveniently pressed into the leaves of the shuttlecock skirt after is has been moulded and a simple pressing tool can be used to simultaneously press them. From an aerodynamic viewpoint it may be immaterial whether the aerofoils are pressed in the half leaves or in the part half leaves although, as indicated above, inward pressing of the part half leaf portions is preferred. Also it may not be necessary to form an aerofoil on every stem of the skirt although this is preferred for reasons of symmetry and visual appeal. Furthermore it will be appreciated that in order for the aerofoils to remain permanently in their "projection" positions, it is necessary to stretch the material beyond its elastic limit or yield point during the pressing operation so that permanent deformation is achieved.

The effect of the aerofoils is that when the shuttlecock moves through the air with the striking cap leading, the air flow over the aerofoil causes a force to be exerted on it whereby a torque is produced about the axis of the shuttlecock which causes it to rotate.

Since it is accepted in the game of badminton that a shuttlecock in flight with cap leading must spin anti-clockwise to have acceptable flight characteristics, it is preferred in the present invention that the aerofoils are positioned to achieve anti-clockwise spin. This will normally be obtained by raising outwardly the separated portions that lie to the right of their stems (when viewing the skirt from outside the shuttlecock when it is vertical with its striking cap lowermost) or by raising inwardly, the trailing edges that lie to the left of their stems.

It will normally be found necessary to provide a circumferentially extending band of the moulded material to join together and thereby reinforce the stems. More than one band may be provided if desired but it is preferred that a band lies at the narrower end of the lower skirt and thereby defines the junction between the lower and upper skirts.

The leaves are preferably shaped to simulate in outline the vexillum or web of the trimmed feathers of a Feather shuttlecock so that each half leaf has the shape of half of a trimmed conventional feather severed along its longitudinal axis or quill.

The amount of spin generated by the aerofoils will depend on their number and size and their position along the length of the stems. As indicated above, there should be from seven to twenty five stems; it is preferred in this invention to use sixteen stems and to have an aerofoil associated with every stem. Regarding the length of the stems, it is preferred that they be from $6\frac{1}{2}$ to $7\frac{1}{2}$ cms long, 7 cms being especially preferred, and that the blade length, i e the length of stem in the vane or lower skirt area, be about 4 cms. The length of the aerofoil, i.e., the length of the portion of the separated edge, is preferably from 8 to 12 mm.

It is also desirable for flight stability that the aerofoils be positioned so that they lie above the centre of gravity of the shuttlecock (assuming that it is vertical with its striking cap lowermost) and the above preferred measurements achieve this effect.

The vane area of a shuttlecock skirt of the invention may be made perforate or imperforate as desired. The half leaves and part half leaves may be moulded with for example ribs and/or bars, narrower than the stems, which define perforations. If desired the visual effect of overlapping feathers may be enhanced by forming the half leaves with smaller perforations (or no perforations) and the part half leaves with larger perforations.

The shuttlecock skirt may be moulded from any suitable material but nylon is preferred. The skirts will normally be made by an injection moulding technique.

The aerofoil flaps formed in the shuttlecock skirts of the present invention may be free to move when the shuttlecock is struck. Thus when the shuttlecock is struck by a racket it initially travels backwards, i.e., striking cap rearmost and, where the flaps extend inwardly the initial increase in air pressure inside the skirt may tend to close the flaps and then, when the shuttlecock turns over in flight so as to travel cap forward—as it should do very shortly after the impact—the flaps can open again. The closing of flaps and trapping of air may explain the very satisfactory "crack" noise that shuttlecocks of the invention emit on striking but it is emphasised that the invention is not intended to be limited by any such theoretical considerations.

The flaps need not necessarily be made movable, however. If desired they could be moulded to have a restraining bar or bars joining them at one or more points to the adjacent half leaf or part leaf from which they have been made separate.

Shuttlecocks constructed according to this invention have been found to have very acceptable flight characteristics and can readily be made within the weight tolerances in force in the officially organised branches of the sport. For example, the preferred weight of a medium speed shuttlecock is 5.2±0.1 grammes.

In fact the flight characteristics of shuttlecocks of the invention have been found to more closely emulate a Feather shuttlecock than any other currently available Moulded shuttlecocks. Those of this invention have very good low travel speed spin characteristics, as well as the more easy to achieve high travel speed spin characteristics, and in fact have a much more consistent spin speed throughout the flight than is normal for a moulded shuttlecock.

The preferred shuttlecocks of the invention will be fitted with cork end caps, although other types, e.g., of foam p.v.c., may be used if desired.

The lower skirt may also, if desired, be provided with shallow undulations at its outermost end, i.e., be provided with an undulating outline in planes perpendicular to the axis of the skirt.

One embodiment of the invention is now described by way of example only with reference to the accompanying drawings in which.

Figure 1:
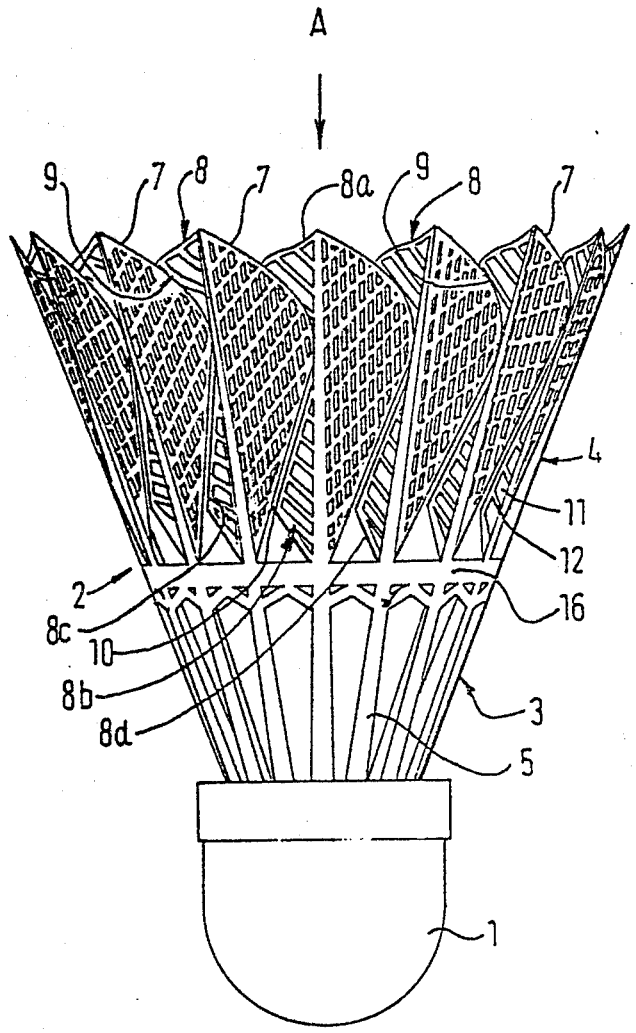
FIG. 1 shows in elevation (but with all details of the rear half removed for clarity) a shuttlecock having a skirt of the invention.
Figure 2:
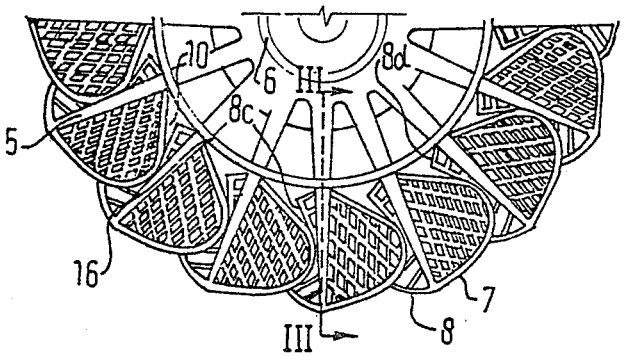
FIG. 2 is a corresponding top half view in the direction of arrow A of FIG. 1.
Figure 3:
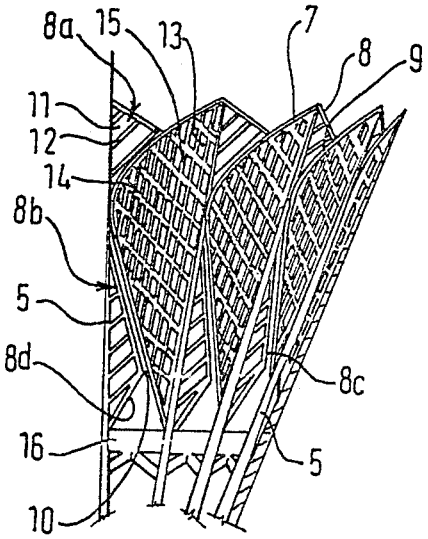
FIG. 3 is a section along line III—III of FIG. 2.

The drawings show a shuttlecock having a striking cap 1 and an integrally-moulded plastics skirt 2. Skirt 2 has an upper skirt 3 and a lower skirt 4, skirt 4 defining the vane area. The skirt is of conical shape and has a diverging array of stems 5 which meet at the narrower end of the skirt to form an end-ring 6 (FIG. 2). Each stem 5 has in the lower skirt region an associated half leaf 7 and part half leaf 8 one on each side of the stem.

Each part half leaf 8 has an outer portion 8*a* i.e., the wider end of the conical skirt, and an inner portion 8*b*, i.e., nearer the narrower end of the conical skirt. Each portion 8*a* of half leaves 8 is joined to the half leaf 7 on the next adjacent stem along a boundary line 9 running from a central portion of its stem 5 to the outer, i.e., wider, end of the skirt whereby a continuous vane area around the skirt is achieved. Each portion 8*b* of part half leaves 8 is separated from half leaf 7 on the next adjacent stem along boundary line 10 running from the central portion of its stem 5 to the inner, i.e., narrower, end of the vane area of the skirt.

Edges 8*c* and 8*d* of each portion 8*b* together with their associated portion of stem 5 form an aerofoil which is bent inwardly with respect to the vane surface generally. In other words the aerofoil is defined by a portion of the stem, the separated edge of the part half leaf and the free edge (or erstwhile trailing edge) of the part half leaf.

Part half leaves 8 have larger perforations 11, defined by ribs 12, then half leaves 7 where smaller perforations 13 are defined by ribs and bars 14 and 15. A reinforcing band 16 runs circumferentially around the skirt defining the junction between the upper and lower skirt.

The striking cap and skirt may be joined by any conventional means by which the narrow end of the latter is securely located within the former.

Having now described my invention—what I claim is:

1. An integrally-moulded shuttlecock skirt having an end ring, an array of diverging stems extending from the end ring to form a generally conical skirt structure, the skirt being composed of an upper skirt and a lower skirt, the lower skirt being furthermost from the end ring and constituting the vane area of the skirt and the surface of the lower skirt being formed of a series of connected half leaves and complementary-shaped part half leaves, each stem in the vane area supporting a half leaf to one side and a part half leaf to the other side, whereby a visual effect of overlapping leaves is achieved, each half leaf and its associated part half leaf being separated along part of the boundary line where they would otherwise appear to overlap, the separated portion of each half leaf being formed in a different plane to its corresponding separated portion of part half leaf.

2. A shuttlecock skirt according to claim 1, in which the separated portions of part half leaves are formed inwardly with respect to the vane surface.

3. A shuttlecock skirt according to claim 1, in which the separated portions of the half leaves are formed outwardly with respect to the vane surface.

4. A shuttlecock skirt according to claim 1, 2 or 3, in which the separation is made towards the narrower end of the skirt.

5. A shuttlecock skirt according to claim 1, 2 or 3, in which the separation is made so as to form an inward projection having sides that are defined by a portion of the stem, the separated edge of the part half leaf and the free edge of the part half leaf.

6. A shuttlecock skirt according to claim 1, 2 or 3, in which the lower skirt occupies from 30% to 70% of the total length of the skirt.

7. A shuttlecock skirt according to claim 1, 2 or 3, which has from 7 to 25 stems.

8. A shuttlecock skirt according to claim 1, 2 or 3, which has an integrally-formed circumferentially-extending band joining together and reinforcing the stems.

9. A shuttlecock skirt according to claim 8, in which the band lies at the narrower end of the lower skirt.

10. A shuttlecock skirt according to claim 1, 2 or 3, in which the leaves are shaped to simulate in outline the vexillum of the trimmed feathers of a feather shuttlecock.

11. A shuttlecock skirt according to claim 1, 2 or 3, in which the stems are from $6\frac{1}{2}$ to $7\frac{1}{2}$ cms long.

12. A shuttlecock skirt according to claim 11, in which the length of the stem in the lower skirt is about 4 cms.

13. A shuttlecock skirt according to claim 1, 2, or 3, in which the length of the separated portion is from 8 to 12 mms.

14. A shuttlecock skirt according to claim 1, 2, or 3, in which the half leaves and/or part half leaves have perforations defined by ribs and/or bars which are narrower than the stems.

15. A shuttlecock skirt according to claim 14, in which the half leaves have perforations that are smaller than the perforations in the part half leaves.

16. A shuttlecock having a striking cap and an integrally-moulded skirt, the skirt having an end ring, an array of diverging stems extending from the end ring to form a generally conical skirt structure, the skirt being composed of an upper skirt and a lower skirt, the lower skirt being furthermost from the end ring and constituting the vane area of the skirt and the surface of the lower skirt being formed of a series of connected half leaves and complementary-shaped part half leaves, each stem in the vane area supporting a half leaf to one side and a part half leaf to the other side, whereby a visual effect of overlapping leaves is achieved, each half leaf and its associated part half leaf being separated along part of the boundary line where they would otherwise appear to overlap, the separated portion of each half leaf being formed in a different plane to its corresponding separated portion of part half leaf.

17. A shuttlecock according to claim 16, in which the separated portions lie above the centre of gravity of the shuttlecock when it is vertical with its striking cap lowermost.

* * * * *